United States Patent [19]

Giraud

[11] 4,078,499

[45] Mar. 14, 1978

[54] SYSTEM FOR TRANSFERRING PASSIVE VEHICLES ON AN ACTIVE MOVABLE TRACK

[75] Inventor: Francois Louis Giraud, Plasir, France

[73] Assignee: Savec, Maureapas, France

[21] Appl. No.: 674,218

[22] Filed: Apr. 6, 1976

[30] Foreign Application Priority Data

Apr. 21, 1975 France ..... 75 12320

[51] Int. Cl.[2] ..... B61B 13/12

[52] U.S. Cl. ..... 104/165; 104/18; 104/147 R; 198/324; 198/334

[58] Field of Search ..... 104/1 R, 18, 20, 25, 104/147 R, 165, 172 R, 172 B; 198/321, 324, 334, 472; 295/85, 34

[56] References Cited

U.S. PATENT DOCUMENTS

| | | | |
|---|---|---|---|
| 2,756,686 | 7/1956 | Kendall et al. | 104/20 X |
| 2,936,873 | 5/1960 | Seidman | 198/324 |
| 3,012,517 | 12/1961 | Gale | 104/20 UX |
| 3,690,267 | 9/1972 | Sutton | 104/165 |
| 3,871,303 | 3/1975 | Woodling | 104/20 |
| 3,944,044 | 3/1976 | Hamy | 198/334 |

*Primary Examiner*—Drayton E. Hoffman
*Assistant Examiner*—Randolph A. Reese

[57] ABSTRACT

This transport system for transferring passive vehicles such as cars, platforms, containers, by means of a continuous-drive conveyor is characterized in that each vehicle comprises, in addition to carrier wheels engaging the main and fixed carrier rail, at least one tire-mounted wheel carried by cross beams projecting laterally from the vehicle, the tire-mounted wheel being adapted to engage intermediate retarding or acceleration tracks, a skid mounted in parallel relationship at the end of the cross beams and adapted to engage endless belts driven at low linear speeds for embarkment and disembarkment purposes, and also for transferring the vehicle to turnaround turntables at the ends of the system, and another skid adapted to engage the main endless belt conveyor for driving the vehicle at high speed.

3 Claims, 3 Drawing Figures

SYSTEM FOR TRANSFERRING PASSIVE VEHICLES ON AN ACTIVE MOVABLE TRACK

The present invention relates to means for transferring passive vehicles such as cars, platforms, containers and the like on an active movable track supporting and driving the vehicle at a track speed V, i.e. at zero relative velocity between the vehicle and the track.

The vehicle is firstly supported by track sections travelling at a relatively low speed $v$ (for instance $\sim$ 0.3 m/s) to enable the passengers to step in and out from the vehicles, and then by intermediate track sections which being submitted to an effort of adherence to its support in order to move at the same speed as said support.

More particularly the transfer from the fast track to the slow track and vice versa may be accomplished by means of one or a plurality of intermediate, movable or fixed track sections, as follows: the vehicle having a mass M engages the intermediate track and leaves the movable track; this engagement with the intermediate track causes a braking force F to develop, thus creating a deceleration $K = F/M$, so as to gradually reduce the relative velocity between the vehicle and its newly-engaged support. Two different cases arise when the vehicle arrives at the unloading and loading station (or the disembarking and embarking station in the case of passengers).

Transfer from the fast track to the slow track; the vehicle travelling at a velocity V on the fast track is transferred to the intermediate track and thus braked to reduce its speed down to a predetermined velocity $V' > v$, then transferred from the intermediate track to the slow track where it is braked again from V' to $v$;

Transfer from the slow track to the fast track: the vehicle travelling at a velocity $v$ on the slow track is transferred to an intermediate support driven at a higher velocity V' and the braking force cancelling the relative velocity $v - V'$ accelerates the vehicle up to $V' \leqq V$, and new transfers will gradually accelerate the vehicle up to velocity V.

The means producing the braking force F may be located either on the vehicle or on the movable track engaging the vehicle, or on the ground in the form of a fixed apparatus.

Since the mass M is variable within wide limits, it is advantageous to create a force F proportional to M for reasons to be set forth presently. However, F may depart from k M for the precision of the system is not infinite, and furthermore F is subject to environmental disturbances. Therefore, the deceleration $k$ is attended by a certain dispersion and may vary uncontrollably between a minimum value $k_1$ and a maximum value $k_2$.

To this end, each vehicle comprises a train of carrier and guide wheels rolling on a fixed tubular rail and at least one lateral tire-mounted wheel parallel to said carrier wheels and adapted to engage the intermediate track, and also two side skids adapted to engage the one the high-speed (V) conveyor and the other a belt adapted for engaging the vehicle on a turntable, or a belt for disengaging the vehicle from the turntable or a passenger embarkment track of a passenger disembarkment track, driven at a speed $v$.

At either end of the line a rotary turntable for turning round the vehicles is provided. The mode of operation of the system according to this invention will now be described by way of example, not of limitation.

The vehicle moving away from the turnaround turntable is driven at a low speed by its end skid engaging a clearing belt, then by another belt for passenger embarkment travelling at a reduced speed of, say 0.35 m/s, and finally by a third belt named the intermediate belt driven at a velocity V' (= 1.5 m/s in the selected example) whereby the vehicle is accelerated up to this velocity through its end skid.

During this initial or starting period, the lateral driving braked wheel is simply suspended in the space; downstream to the above-described driving belts in an acceleration belt driven at a velocity V = 4.5 m/s and engaged by the vehicle driving braked wheel until the intermediate skid engages the driving conveyor travelling at the cruising speed V.

On the opposite side there is provided above the conveyor a braking track adapted to slow down the vehicle through its driving braked wheel; this track is followed by a transient belt travelling at a velocity V' 1.50 m/s in order further to slow down the vehicle, the lateral skids being now unsupported or loose in the space.

Downstream of this transient belt and in mutual alignment are a passenger disembarkment belt travelling at a speed of, say, 0.35 m/s, and a belt for engaging the vehicle on the rotary turnaround turntable, the intermediate skid being released from the conveyor which may be interrupted or not.

The lengths and travelling velocities of the transient disembarkment and turnaround belts should be calculated to cause a vehicle to come nearly to a standstill and thus enable the passengers to step in and out while bringing the vehicle onto the turnaround turntable without braking the vehicle excessively since this might cause two closely-spaced vehicles to collide.

The braking system may be of any suitable and known type operating by friction, gravity, electro-magnetic force, fluid reaction, etc.

A typical embodiment of this system for transferring vehicles from the conveyor to the embarkment and disembarkment stations, and to the turnaround stations, will now be described more in detail with reference to the accompanying drawing, in which.

Figure 1:
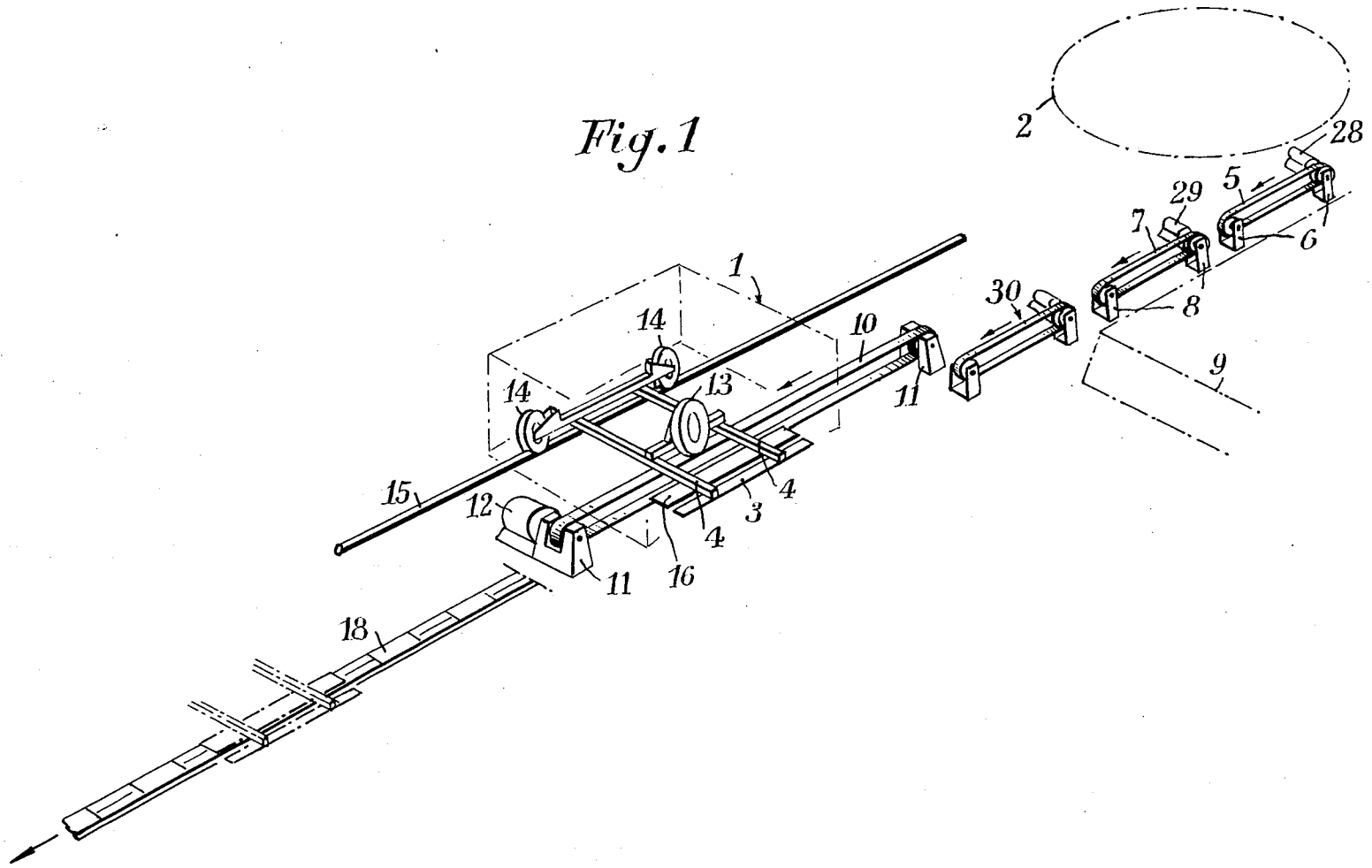
FIG. 1 is an explanatory and diagrammatic perspective view showing the passenger embarkment station.

On the embarkment side (FIG. 1) the vehicle 1 moving away from the turnaround turntable 2 is driven through a lateral skid 3 mounted to the outer end of a cross beam 4 by an endless clearing belt 5 supported by fixed brackets 6 and revolving at a relatively low velocity (1.5 m/s) controlled through a motor 28. The same skid 3 then engages another endless belt 7 carried by brackets 8 and aligned with the preceding belt 5. This other belt 7 is driven by a motor 29 at a lower linear velocity v (0.35 m/s) to permit the embarkment of passengers or goods from a quay 9.

Following this belt 7 is a third endless belt 30 constituting an acceleration track up to the launching track operated at velocity V. This last track consists of a longer endless belt 10 shifted laterally with respect to the preceding belts and mounted on fixed or movable brackets 11; this longer belt 10 is driven at a linear velocity causing the vehicle to accelerate the lateral tire-mounted wheel 13 of the vehicle engaging said belt 10, as shown in FIG. 1.

During this transfer the vehicle 1 is carried by its carrier wheels 14 rolling on a fixed tubular rail 15 of the transport line.

The thus accelerated vehicle is then driven at the cruising speed by means of an intermediate skid 16 mounted to said cross beams 4 and engaging the conveyor, for instance a chain conveyor 18.

The vehicle 1, upon completion of its travel on the cruising track 18, arrives at the disembarkment station where a ramp 19 is provided for braking the wheel 13. Next to this braking ramp 19 is a slow transient travel belt 20 driven from a motor 21 and engaged by the wheel 13 as in the case of the intermediate belt at the embarkment station.

Thus, the vehicle speed is reduced to a value V′ and another belt 22 is disposed at a laterally shifted location for engagement by skid 3; this belt 22 is driven through a reducing gear 23 from the motor 21 driving the main belt 20 at a speed low enough to enable the passengers to step out from the vehicle.

In alignment with, and downstream of, the belt 22 is another endless belt 24 for guiding the vehicle towards the turntable 25.

The chain conveyor 18 comprises adjacent the turntable 25 a loop section 26 leading to the station from which the vehicle is returned to the embarkment station 2.

Figures 2, 3:
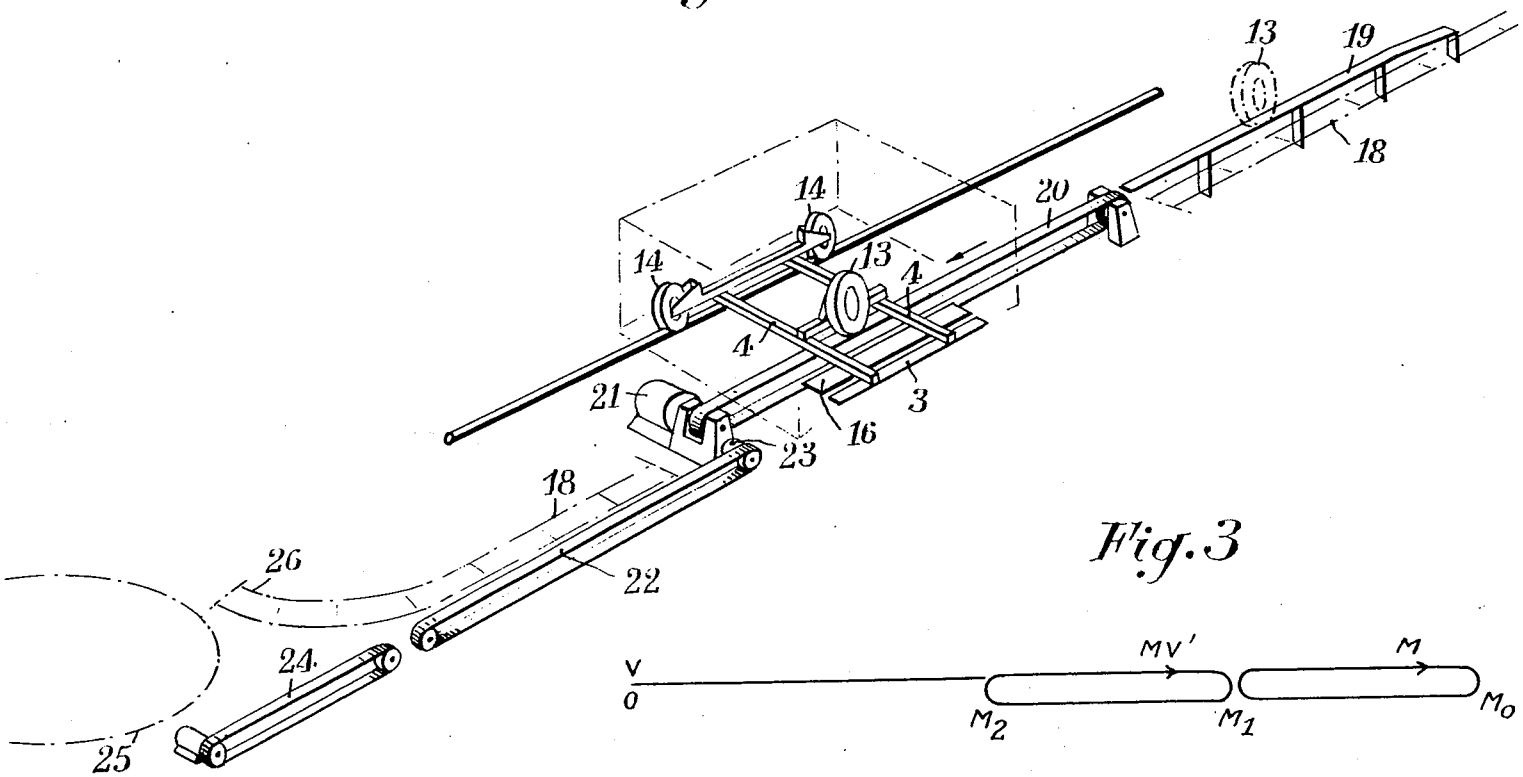
FIG. 2 is a similar view showing the disembarkment station.
FIG. 3 is a diagram to which reference will be made for explaining the kinematics of the present invention.

According to the laws of mechanics, the deceleration $k$ produced by the braking force $k$ is the same for an observer travelling with the movable track, provided that this track be driven at a constant velocity (FIG. 3).

In FIG. 3, considering a vehicle disengaged from the fast track V but engaging another support at a point O fixed in relation to an absolute reference (the ground), the velocity $V' < V$ will be reached at a point M such that:

$$V^2 - V'^2/2 = k \cdot OM$$

wherein the smaller $k$, the greater OM. If $k$ lies in the range from $k_1$ to $k_2$, as explained in the foregoing, M will lie between points $M_2$ and $M_1$ such that:

$$V^2 - V'^2/2 = k_1 \cdot OM_1 = k_2 \cdot OM_2$$

The length of the intermediate braking track as described hereinabove is at least $M_1 M_2$ and measured between the ramp $OM_2$ and the disembarkment belt $M_1$ and $M_0$; this track comrises at least one section having a length:

$$M_2 M_1 = V^2 - V'^2/2\,[1/k_1 - 1/k_2]$$

travelling at a constant velocity V′; the section $OM_2$ may be driven at any velocity lower than or equal to V′, but the simplest device will preferably be a fixed track, or a track with velocity V′, whereby the track ($OM_2 + M_2 M_1$) will consist of a single component with velocity V′.

If the braking device is such that it decelerates the vehicle between the controlled limits $k_1$ and $k_2$ the vehicle, after having attained at M the velocity V′, is brought from M to $M_1$ to a relative standstill, i.e. at the velocity V′ of the support. Therefore, all the vehicles are transferred at $M_1$ to the slow unloading or disembarkment track at said velocity V′, which is advantageous in that it makes it possible:

to ensure that all the vehicles are returned to the station, provided that they reach at least point $M_2$, which is always possible if a sufficient speed V′ is chosen for the intermediate track.

to avoid any collision up to point $M_1$; and to avoid the effects of dispersion on the slow track, since all the vehicles reach it at the same speed V′, whereby the minimum safety distance or headway between adjacent vehicles can be reduced.

Now, if the dispersion of the braking distances on the slow track is $l$, and the length of the vehicles is L, the minimum distance between the vehicles which must be maintained to prevent from hitting one another on this track should be in the range of L to $(L + l)$, and the maximum flow on the line will be:

$$v/L + l$$

If the intermediate track were not provided, the dispersion of the braking distances from V to $v$ will be $l_1$, that is, substantially greater than $l$, and the minimum vehicle flow will be considerably lower:

$$v/L + l_1.$$

Calculations for determining the optimum values show that the optimum intermediate velocity is about V/3 and that the introduction of an intermediate track will nearly double the maximum flow of vehicles for a same anti-collision safety condition.

This invention is applicable to the acceleration phase by introducing, between the slow loading or embarkment track and the speed track V accelerating the vehicle up to the fast-speed track velocity, an intermediate track driving the vehicle at a velocity V′, with the advantageous consequences that:

the vehicle dispersion along the starting distance at speed V, is reduced by reducing this speed to $$V^2 - V'^2/2$$

(however this reduction is appreciable only if V′ is relatively high);

the vehicle loaded on this intermediate support can be stopped without any excessive deceleration, in case the next station is congested by an excessive number of vehicles, and safety can be improved by delaying the moment when the vehicle is accelerated until the passengers are properly accommodated in the vehicle.

Of course, the exemplary form of embodiment illustrated in the drawing and described hereinabove should not be construed as limiting the scope of the invention since many modifications and changes may be brought thereto without departing from the basic principles of the invention as set forth in the appended claims.

What is claimed as new is:

1. Transport system comprising:

at least one high-velocity transport conveyor;

at least one belt-type embarking conveyor operable at a relatively low velocity;

at least one belt-type disembarking conveyor operable at a relatively low velocity;

at least one active intermediate acceleration track disposed between said at least one embarking conveyor and said at least one transport conveyor;

at least one intermediate active deceleration track disposed between said at least one transport conveyor and said at least one disembarking conveyor, the velocities of said intermediate active tracks being intermediate said low and high velocities;

a guide rail, and at least one vehicle comprising a frame having first and second beams, a guide wheel adapted to engage said guide rail, a tire-mounted wheel carried by said first beam of said frame and adapted to engage at least one of said intermediate tracks, a first shoe adapted to engage said at least one transport conveyor, and a second shoe mounted at the end of said second beams of said frame and adapted to engage said belt-type embarking and disembarking conveyors.

2. Transport system comprising:

at least one high-velocity transport conveyor;

at least one belt-type embarking conveyor operable at a relatively low velocity;

at least one active intermediate acceleration track disposed between said at least one embarking conveyor and said at least one transport conveyor, the velocity of said intermediate active track being intermediate said low velocity embarking conveyor and said high velocity transport conveyor;

a guide rail, and at least one vehicle comprising a frame having first and second beams, a guide wheel adapted to engage said guide rail, a tire-mounted wheel carried by said first beam of said frame and adapted to engage said intermediate track, a first shoe adapted to engage said at least one transport conveyor, and a second shoe mounted at the end of said second beam of said frame and adapted to engage said belt-type embarking conveyor.

3. Transport system comprising:

at least one high-velocity transport conveyor;

at least one belt-type disembarking conveyor operable at a relatively low velocity;

at least one intermediate active deceleration track disposed between said at least one transport conveyor and said at least one disembarking conveyor, the velocity of said intermediate active track being intermediate said low velocity disembarking conveyor and said high velocity transport conveyor a guide rail, and at least one vehicle comprising a frame having first and second beams, a guide wheel adapted to engage said guide rail, a tire-mounted wheel carried by said first beam of said frame and adapted to engage said intermediate track, a first shoe adapted to engage said at least one transport conveyor, and a second shoe mounted at the end of said second beam of said frame and adapted to engage said belt-type disembarking conveyor.

* * * * *